US007225751B2

(12) United States Patent
Rueckert

(10) Patent No.: US 7,225,751 B2
(45) Date of Patent: Jun. 5, 2007

(54) CONNECTING LINK ASSEMBLY AND SOCKET ARRANGEMENT FOR ASSEMBLY OF FLOATING DRIVE-ON DRY DOCKS

(76) Inventor: David Rueckert, 18860 Loxahatchee River Rd., Jupiter, FL (US) 33458

( * ) Notice: Subject to any disclaimer, the term of this patent is extended or adjusted under 35 U.S.C. 154(b) by 72 days.

(21) Appl. No.: 11/143,797

(22) Filed: Jun. 1, 2005

(65) Prior Publication Data

US 2006/0272566 A1 Dec. 7, 2006

(51) Int. Cl.
*B63B 35/40* (2006.01)

(52) U.S. Cl. ..... 114/259; 114/263

(58) Field of Classification Search ..... 114/259, 114/263

See application file for complete search history.

(56) References Cited

U.S. PATENT DOCUMENTS

| | | | | |
|---|---|---|---|---|
| 2,894,472 | A | | 7/1959 | Foster |
| 3,824,644 | A | | 7/1974 | Stranzinger |
| 3,951,087 | A | | 4/1976 | Carson |
| 3,977,030 | A | | 8/1976 | Ringdal |
| 4,018,179 | A | | 4/1977 | Rutter |
| 4,510,877 | A | | 4/1985 | Bloxham |
| 4,604,962 | A | | 8/1986 | Guibault |
| 4,655,156 | A | | 4/1987 | Svirklys et al. |
| 5,251,560 | A | | 10/1993 | Ban et al. |
| 5,529,013 | A | | 6/1996 | Eva, III et al. |
| 5,682,833 | A | | 11/1997 | Eva, III et al. |
| 5,795,098 | A | * | 8/1998 | Rueckert ..... 405/7 |
| D398,576 | S | * | 9/1998 | Hillman et al. ..... D12/316 |
| 5,875,727 | A | | 3/1999 | Elson et al. |
| 5,931,113 | A | | 8/1999 | Eva, III et al. |
| 5,941,660 | A | | 8/1999 | Rueckert |
| 5,947,049 | A | | 9/1999 | Elson |
| 5,947,050 | A | | 9/1999 | Eva, III et al. |
| 6,033,151 | A | | 3/2000 | Tsou |
| 6,073,572 | A | | 6/2000 | Gruhn et al. |
| 6,138,599 | A | | 10/2000 | Elson |
| 6,138,600 | A | | 10/2000 | Berquist |
| 6,179,525 | B1 | | 1/2001 | Gruhn et al. |
| 6,602,022 | B1 | | 8/2003 | Wilkins |
| 6,745,714 | B1 | | 6/2004 | Faber |
| D506,431 | S | * | 6/2005 | Elson ..... D12/316 |
| 2005/0204989 | A1 | * | 9/2005 | Ahern ..... 114/266 |

* cited by examiner

*Primary Examiner*—Stephen Avila
(74) *Attorney, Agent, or Firm*—McHale & Slavin, PA

(57) ABSTRACT

The present invention provides a connecting link assembly and socket arrangement for assembling modular dock and/or deck elements into walkways, decks and drive-on docks.

19 Claims, 7 Drawing Sheets

CONNECTING LINK ASSEMBLY AND SOCKET ARRANGEMENT FOR ASSEMBLY OF FLOATING DRIVE-ON DRY DOCKS

FIELD OF THE INVENTION

This invention is directed to floating drive-on dry docks and, in particular, to a connecting link and socket arrangement for connecting floating structural members into substantially rigid floating drive-on dry docks and floating decks.

BACKGROUND OF THE INVENTION

In the past, modular floating docks have been created by the assembly of a number of floating subunits. These subunits include various geometric shapes with planar upper and lower surfaces. The subunits connect together to create flexible docks and walkways having various shapes and sizes based on the consumers needs.

For example, U.S. Pat. Nos. 3,824,644 and 4,604,962 disclose a substantially prismatic, floating element having rounded corner edges. The elements are provided with outwardly projecting eye lugs for flexible attachment to adjacent elements.

U.S. Pat. No. 4,655,156 discloses a stackable floating element. The elements include alternating rectangular projections and cavities for interlocking the elements in a stacked arrangement. The stacked arrangements are secured together via tabs and bolts to create a flexible assembly.

U.S. Pat. No. 5,251,560 discloses a water-float coupling device for coupling together hexagonally shaped floats having planar upper and lower surfaces. The device extends through a plurality of stacked outwardly extending tabs for flexible connection between the units.

U.S. Pat. No. 6,033,151 discloses a float unit having planar upper and lower surfaces and corrugated side surfaces. The corrugated side surfaces engage with adjacent floats to provide friction between the units. The units are secured together by extending a bolt through stacked tabs which extend outwardly from the corners of each float unit.

U.S. Pat. Nos. 6,138,599 and 5,947,049 disclose a buoyant walkway module for a boatlift. The device includes a plurality of elongated compartments having planar top and bottom surfaces. The device also includes planar ends for connecting the walkways together in an end to end relationship.

U.S. Pat. Nos. 6,073,572 and 6,179,525 disclose floating dock sections. The sections are interlocked via a number of flanges to create decks or walkways.

U.S. Pat. No. 6,138,600 discloses a hollow float that includes a hollow inner cavity and a plurality of open cavities that extend upward from the bottom surface of the float.

U.S. Pat. No. 5,875,727 discloses a floating lift for docking a personal watercraft from a body of water. The float includes a shell filled with a buoyant filler. A replaceable skid plate is centered on one end of the shell to engage the bow of a watercraft during docking. The shell includes two pairs of posts, one pair extending forwardly from the front of the shell and the other extending rearward from the rear of the float. A flat elastic member is used to extend between posts of adjacent shells to flexibly connect the shells together.

These prior art devices work relatively well for constructing flexible walkways and platforms. However, these devices have numerous shortcomings. The size of the floatation units and the flexible connection between the units causes the units to closely follow the contour of the water. This construction also causes instability and makes the units difficult to walk along. When weight is applied to small individual units they displace downwardly, when the weight is removed the floats follow the load upward. This action gives an individual a similar sensation to walking on a rope bridge.

It is also known in the prior art to construct floating flexible or pivotable drive-on type docks. The docks are assembled from floating elements having various geometric shapes to create a dock which allows a boat operator to drive his/her watercraft directly onto the upper surface of the dock using the boats power. As the watercraft is driven onto the dock the floating elements typically flex or pivot downward to a position below the water-line until a sufficient amount of floatation devices are beneath the watercraft to raise it above the water line.

For example, U.S. Pat. No. 3,977,030 discloses a metal frame upon which buoyancy elements are rotatably and pivotably mounted.

U.S. Pat. Nos. 5,529,013 5,682,833, and 5,947,050 disclose a floating dry dock consisting of two arms constructed from short and tall cubical floatation units having an open well in the middle portion thereof. The floatation units having the least buoyancy are secured at the distal ends of the arms for downward pivotal movement under the water surface during boat docking.

U.S. Pat. No. 5,941,660, issued to the instant inventor, teaches a watercraft support structure formed from a plurality of platforms that are coupled together by linking pins or insertion plugs for a limited amount of pivotal movement during docking.

U.S. Pat. Nos. 3,951,087 and 6,602,022 disclose apparatus for lifting and storing a boat above the water in the well of a dock or floating dry dock. The device includes a metal frame onto which the boat may be driven. The frame is pivotally mounted within the open well such that the frame can be tilted downward when loading the boat and thereafter be pivoted to a level position.

While these designs are functional, they have numerous shortcomings that have not been addressed in the art. For example, in order to provide guidance for the boat hull when used for drive-on docking, the planer surfaced flotation units must be spaced apart leaving an open well between the two arms. This construction provides a poor guiding surface for most boat hull constructions. In addition, the narrow width of the floatation units and the flexible connections associated therewith make these structures extremely unstable for pedestrian traffic and unsuitable for decks or walkways. This safety hazard is magnified when the docks are used at night or in rough waters.

Still further, the open wells within these dock assemblies combined with the wave action associated with large bodies of water often results in repeated splashing of water into the drive units of the docked watercraft and thus causes premature failure of important components of the watercraft drive system. Keeping a watercraft high and dry when not in use is important to protecting the machinery of the craft. This is particularly true of jet type propulsion systems and is critical when the craft is docked in salt water.

Other floating drive-on docks of the prior art are constructed to be lowered below the water-line with ballast for loading a watercraft. These float units are typically filled with water until the watercraft has been loaded. Thereafter, the water ballast is forced from floatation units with air to raise the watercraft above the surface of the water. As described above, the floatation units are generally cubical with tabs projecting from the vertical edges at or near the horizontal midline for flexible attachment to adjacent units. Alternatively the floating units may be supplied in the form of pontoons or other hollow structures which may alternately be filled with water and air. For example, U.S. Pat. Nos. 2,894,472, 4,018,179, 4,510,877, 5,931,113 and 6,745,714 show similarly constructed devices.

In addition to the shortcomings described above, the air systems utilized within these devices are complex and significantly increase the initial cost of the dock. In addition, cost of maintaining the air and water pumps in a marine environment is increased, while reliability of the systems is decreased.

Thus, what is needed in the art is a connecting link assembly and socket arrangement for assembling modular dock elements into walkways, decks and drive-on docks to provide increased versatility and safety. The connecting link and the connecting link socket should have conjugate profiles that are easily molded from polymeric materials and methods well known in the art. The connecting link assembly and socket arrangement should cooperate in such a manner to allow substantially rigid drive-on docks and decks to be easily and quickly assembled with a minimum number of tools. The structural floating elements should provide a surface which allows a watercraft to slide easily for drive-on docking without hull damage, while providing superior grip for pedestrian traffic. The structural elements may be constructed with like or dissimilar buoyancies for increased assembly versatility. Structural floating elements should also provide a guiding surface for boat hulls when being driven onto the dock. The guiding surfaces should be provided without dangerous open wells.

SUMMARY OF THE INVENTION

The present invention provides a connecting link assembly and socket arrangement for assembling modular dock and/or deck elements into walkways, decks and drive-on docks.

In one embodiment a structural floating deck element is preferably a polyhedron in overall shape including a first, generally planar, upper surface adapted for use as a deck, a second lower surface and a plurality of side walls for adjoining and maintaining spacing between the first surface and the second surface. A plurality of socket apertures may extend around the perimeter of the deck element in predetermined intervals for attachment to adjacent floating elements. The inner cavity of the floating deck element may be filled with expanded polymeric material, e.g. foam, to provide rigidity to the deck element and/or buoyancy in the event that one of the surfaces or side walls are breached. Alternatively, the inner cavity of the floating deck element may be partially filled with ballast to change the floating characteristics of the dock and/or deck.

The deck element's upper surface, lower surface and the plurality of side walls are formed of polymeric material(s) by conventional methods well known in the art. Using these methods, the upper surface, lower surface and side walls may be formed continuous or they may include at least one aperture therethrough. In one embodiment the aperture is constructed and arranged to allow the buoyancy of the deck element to be altered by the addition of ballast. Cooperating with the aperture is one of a variety of caps or plugs. The cap may be constructed and arranged to maintain air tightness within the floatation element or the cap may be adapted to include a vent or membrane to allow air and/or water to flow inwardly and outwardly from within the dock or deck element.

In one embodiment, a structural floating dock element is generally a polyhedron in shape including a upper receiving surface adapted for receiving a watercraft, a lower surface, a front wall, a back wall and two side walls for adjoining and maintaining spacing between the upper surface and the lower surface. A plurality of socket apertures may extend around the perimeter of the dock element in predetermined intervals for attachment to adjacent floating dock and/or deck elements.

The front wall may include a V-shaped entrance guide for aligning and lifting the keel of a watercraft during drive-on docking. The upper receiving surface preferably includes two upward standing and generally parallel guide and support rails spaced apart and connected by a lowered trackway surface. The two generally parallel guide and support rails are constructed and arranged to cooperate with a boat keel and hull to provide guiding and support when used for drive-on docking.

The deck element's upper surface, lower surface and the plurality of side walls are formed of polymeric material(s) by conventional methods well known in the art. Using these methods, the upper surface, lower surface and side walls may be formed continuous or they may include at least one aperture therethrough. In one embodiment the aperture is constructed and arranged to allow the buoyancy of the dock element to be altered by the addition of ballast. Cooperating with the aperture is one of a variety of caps or plugs. The cap/plug may be constructed and arranged to maintain air tightness within the floatation element or the cap/plug may be adapted to include a vent or membrane to allow air and/or water to flow inwardly and outwardly from within the dock element.

The cooperating sockets and connecting links are constructed and arranged for linking adjacently positioned deck and/or dock elements together into a substantially rigid assembly. The cooperating sockets and connecting links may be arranged so that the uppermost surfaces of the adjacent dock and/or deck elements are substantially coplanar, or so that the uppermost surfaces of adjacent floatation elements are vertically offset and generally parallel to create an upper surface and a lower surface.

The sockets in both the deck and dock elements are arranged to align with at least one socket of an adjacent deck and/or dock element. In a preferred embodiment at least two sockets are arranged for alignment with at least two sockets within adjacent deck and/or dock elements. The sockets each preferably include an aperture, a contoured upper pocket and a contoured lower pocket. The contoured upper and lower pockets in the preferred embodiment have sufficient depth to create a substantially flat upper surface when the connecting links are installed. In alternative embodiments the depth of the upper or lower pockets may be adjusted to permit uneven or stepped upper surfaces between adjacent deck and/or dock elements. The aperture extends through the dock or deck element and is preferably round having sufficient diameter to accept a standard four inch diameter pvc pipe. This construction permits the socket aperture to be used for securing the deck or dock elements to a stationary structure while allowing the elements to rise and fall with tides and water levels.

The connecting link includes a lower portion and an upper portion. The lower portion includes a lower plate and a pair of upstanding integrally formed pins. An integrally formed rib extends between the upward standing pins to add strength and rigidity to the connecting link. The upper portion of the link includes an upper plate, the upper plate includes a pair of apertures. The apertures are arranged to permit the upper plate to be secured to the upward standing pins of the lower portion via fasteners.

It should also be appreciated that the floatation elements may be formed in various other polyhedral shapes that are adapted to fit together suitably for use as floating walkways, docks or decks. Some of these shapes may include, but should not be limited to rectangles, squares, pentagons, hexagons, octagons and the like.

Thus, it is an objective of the instant invention to provide a modular floating deck element for use in assembling substantially rigid walkways, decks and docks.

Another objective of the instant invention is to provide a floating dock element having a upper keel guiding surface, a lower generally planar surface and a plurality of sidewalls that are continuously formed.

A further objective of the instant invention is to provide a floating deck element having a upper generally planar surface, a lower generally planar surface and a plurality of sidewalls.

An additional objective of the instant invention is to provide floating deck and dock elements which can be assembled into a substantially rigid drive-on dock assembly that provides increased safety by not requiring open wells or gaps between floatation elements for drive-on operation.

Yet another objective of the instant invention is to provide a connecting link which cooperates with a plurality of deck and/or dock elements to assemble a substantially rigid deck, walkway or drive-on dock.

Still another objective of the instant invention is to provide floatable deck and dock elements which include internal cavities filled with expanded polymeric foam to provide rigidity to the dock or deck elements and buoyancy in the event of an element breach.

Still yet another objective of the instant invention is to provide a floating dock element having a upper planer surface that can be utilized to assemble substantially rigid decks and walkways.

Still yet another objective of the instant invention is to provide a floating dock element having a V-shaped entrance guide and integrally formed guide rails which can be utilized for guiding and lifting the keel of a watercraft onto a drive-on dock assembly.

Still yet another objective of the instant invention is to provide a floating drive-on dock wherein the upper surface of the dock stays substantially above the waterline during drive-on watercraft docking.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
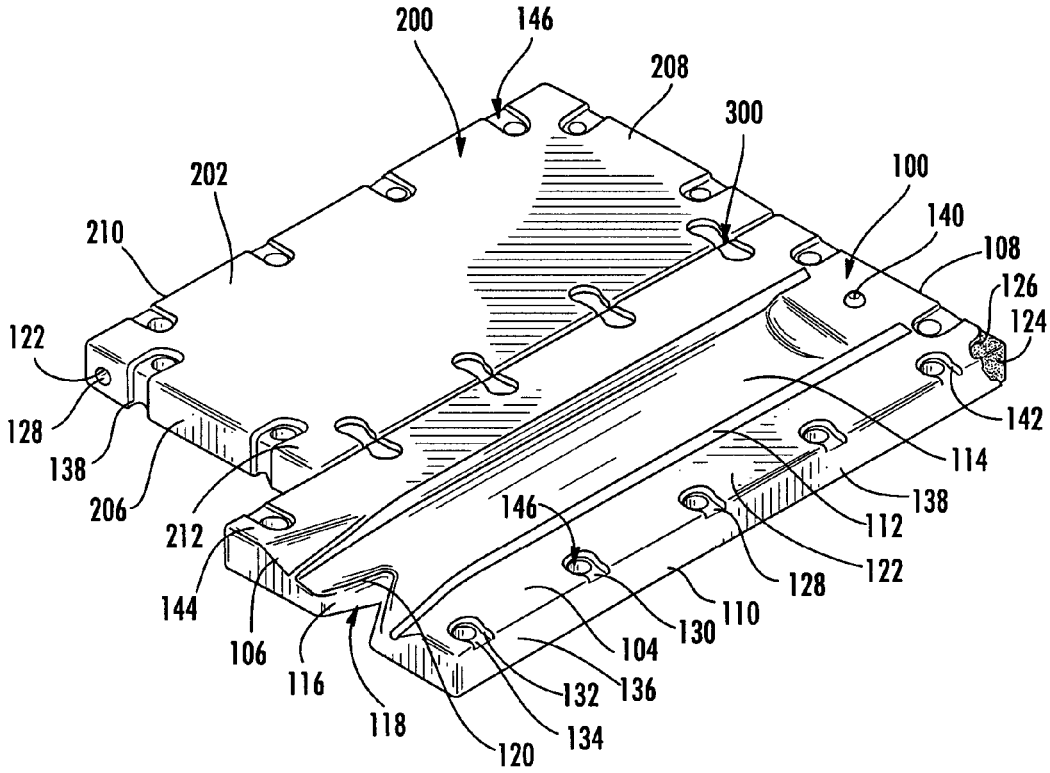
FIG. 1 is a perspective view, partially in section, illustrating dock and deck elements attached with the connecting link assembly of the instant invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 2:
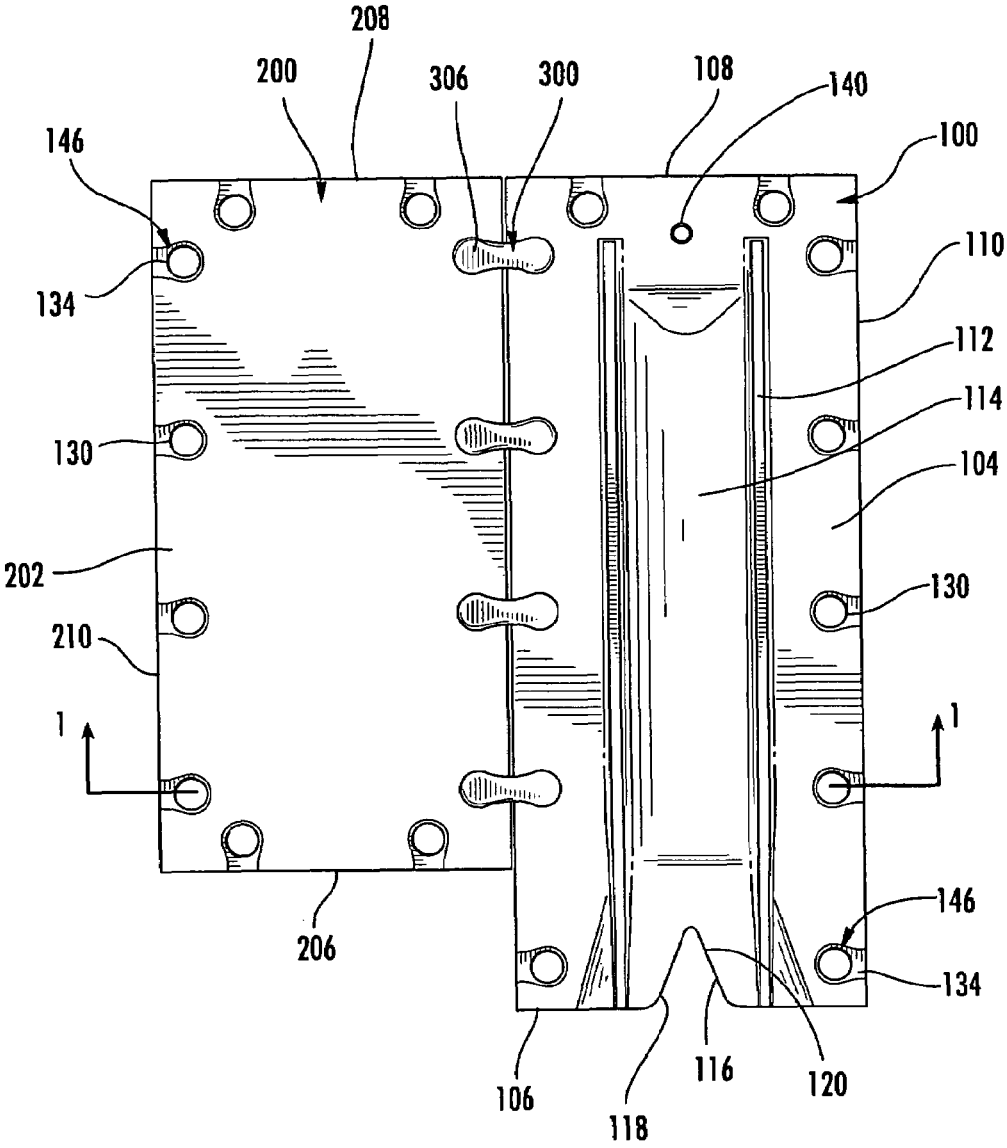
FIG. 2 is a top view illustrating dock and deck elements attached with the connecting link assembly of the instant invention.
Figure 3:
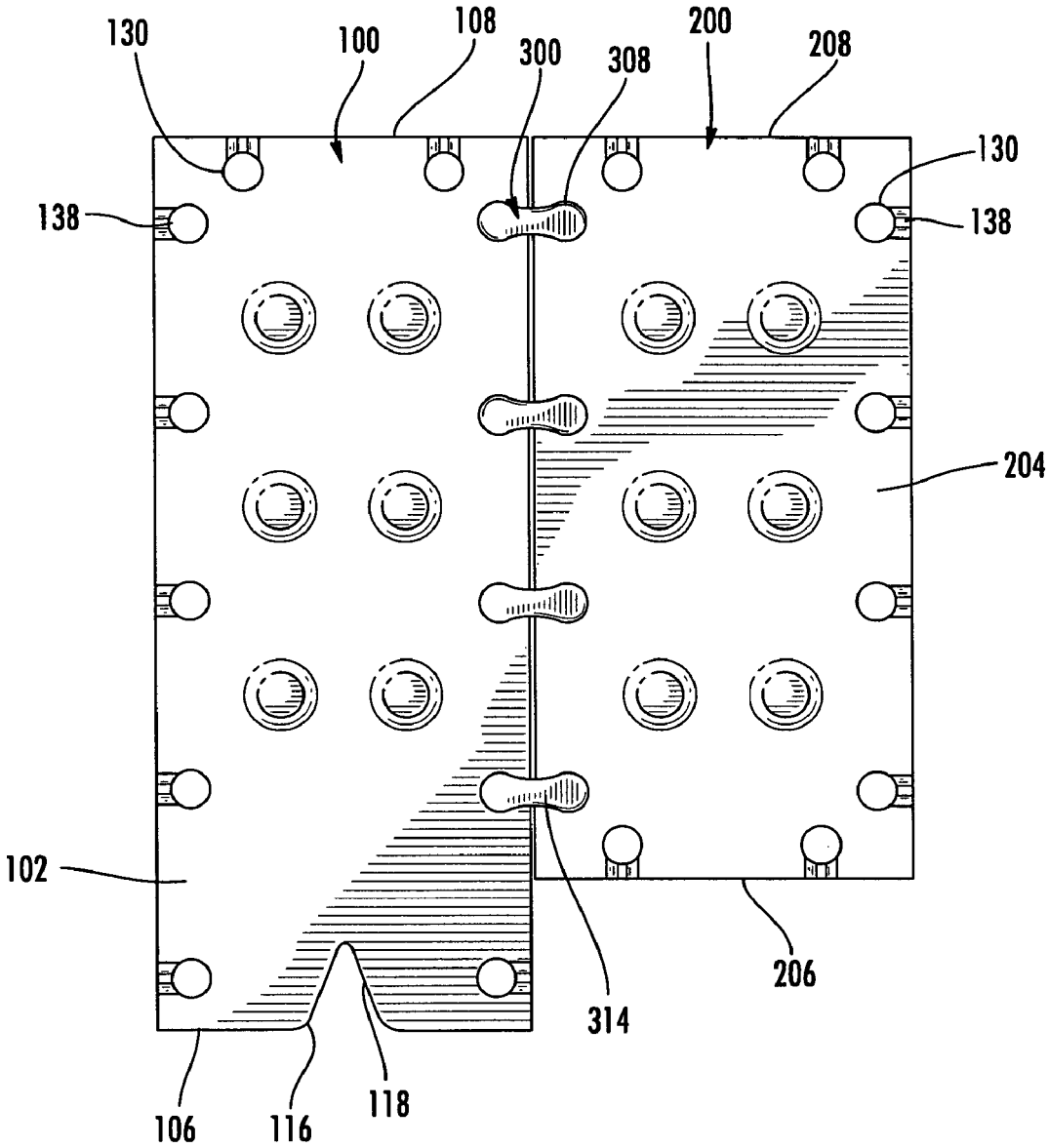
FIG. 3 is a bottom view illustrating dock and deck elements attached with the connecting link assembly of the instant invention.
Figure 4:
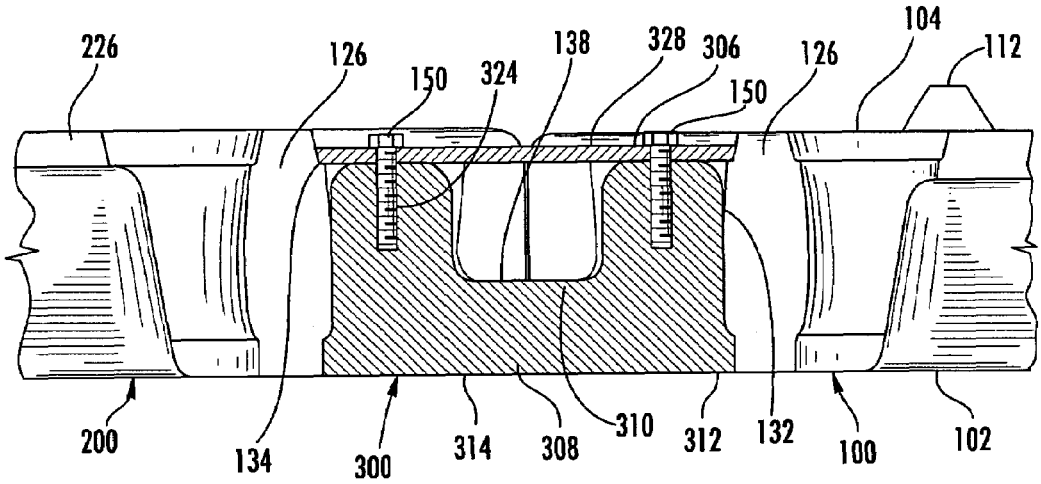
FIG. 4 is a partial section view taken along lines 1—1 of FIG. 2 illustrating the connecting link assembly and socket arrangement of the instant invention.
Figure 5:
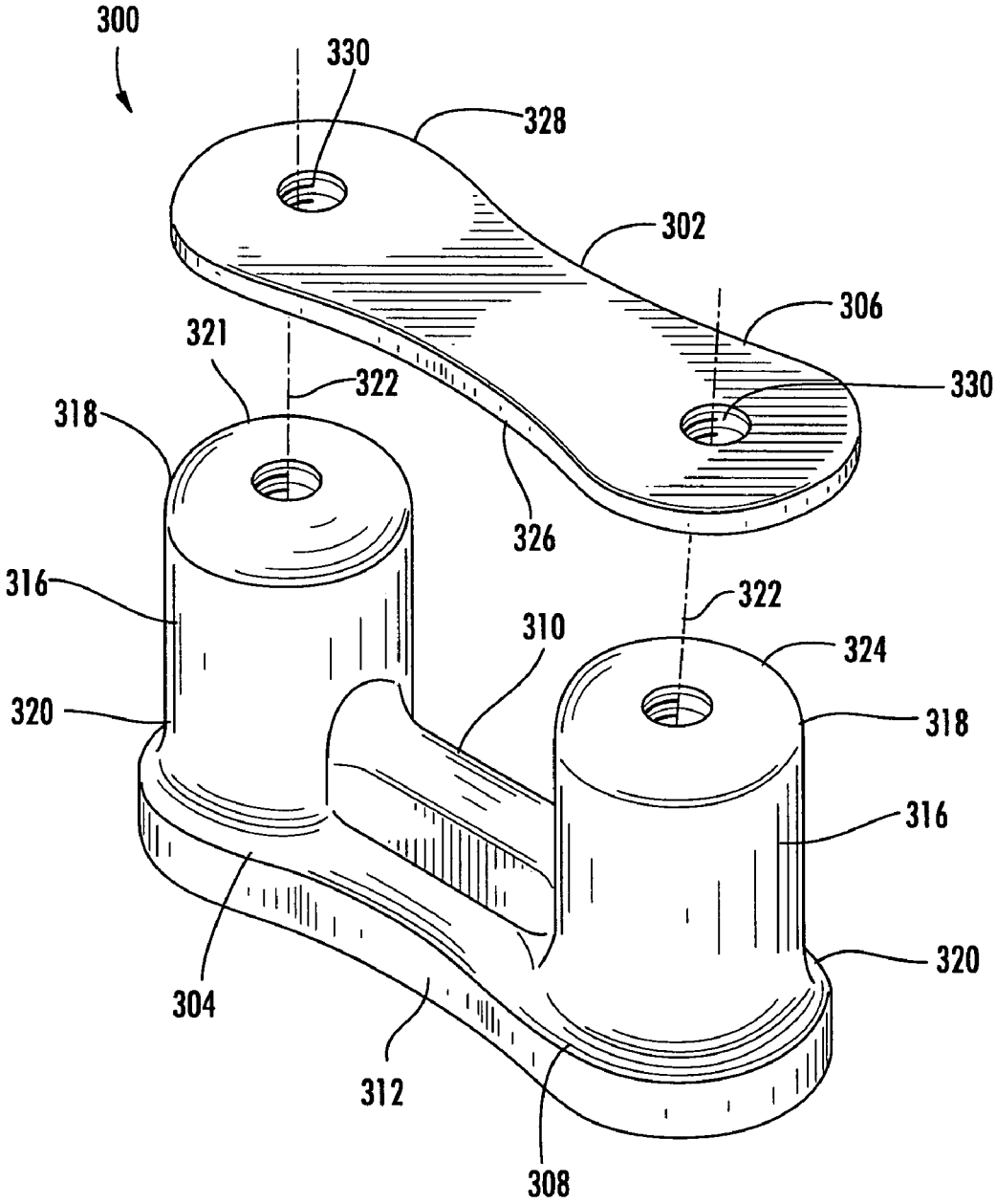
FIG. 5 is an exploded perspective view of the connecting link of the instant invention.
Figure 6:
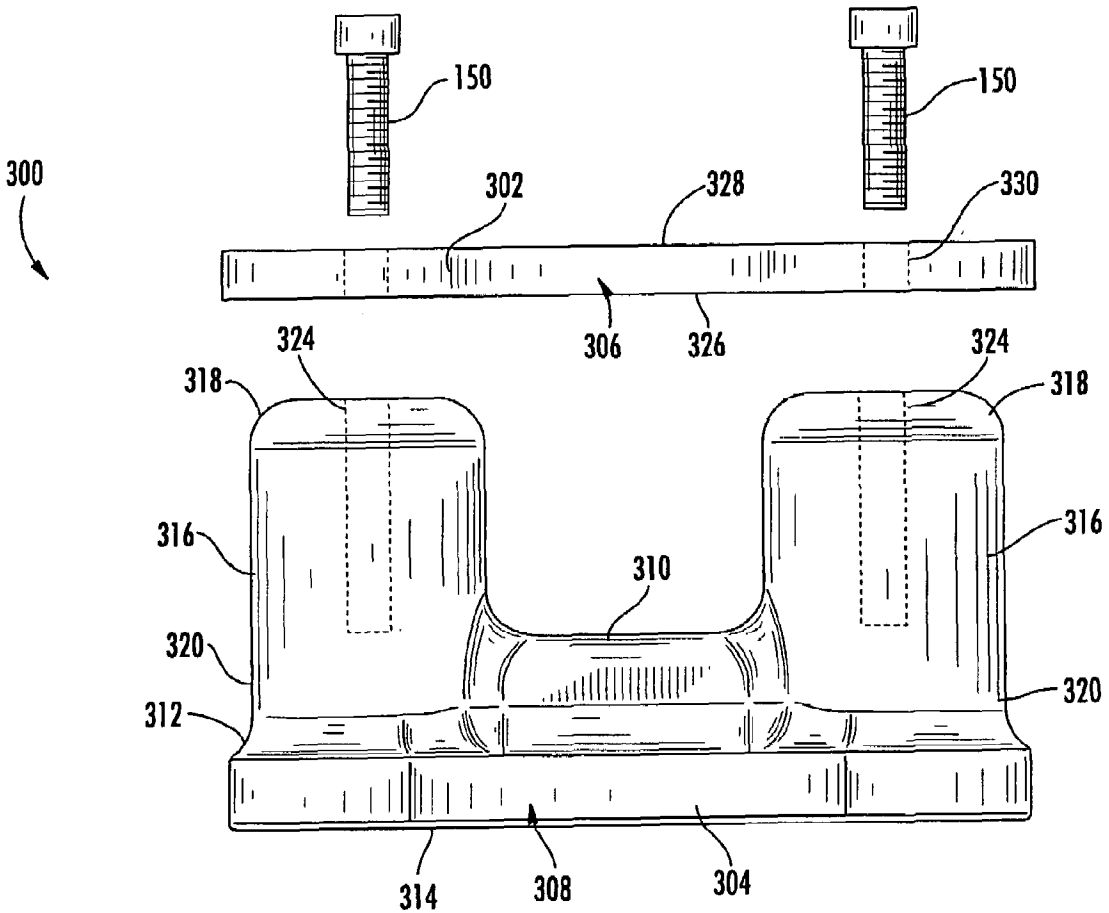
FIG. 6 is a side view of the connecting link of the instant invention.
Figure 7:
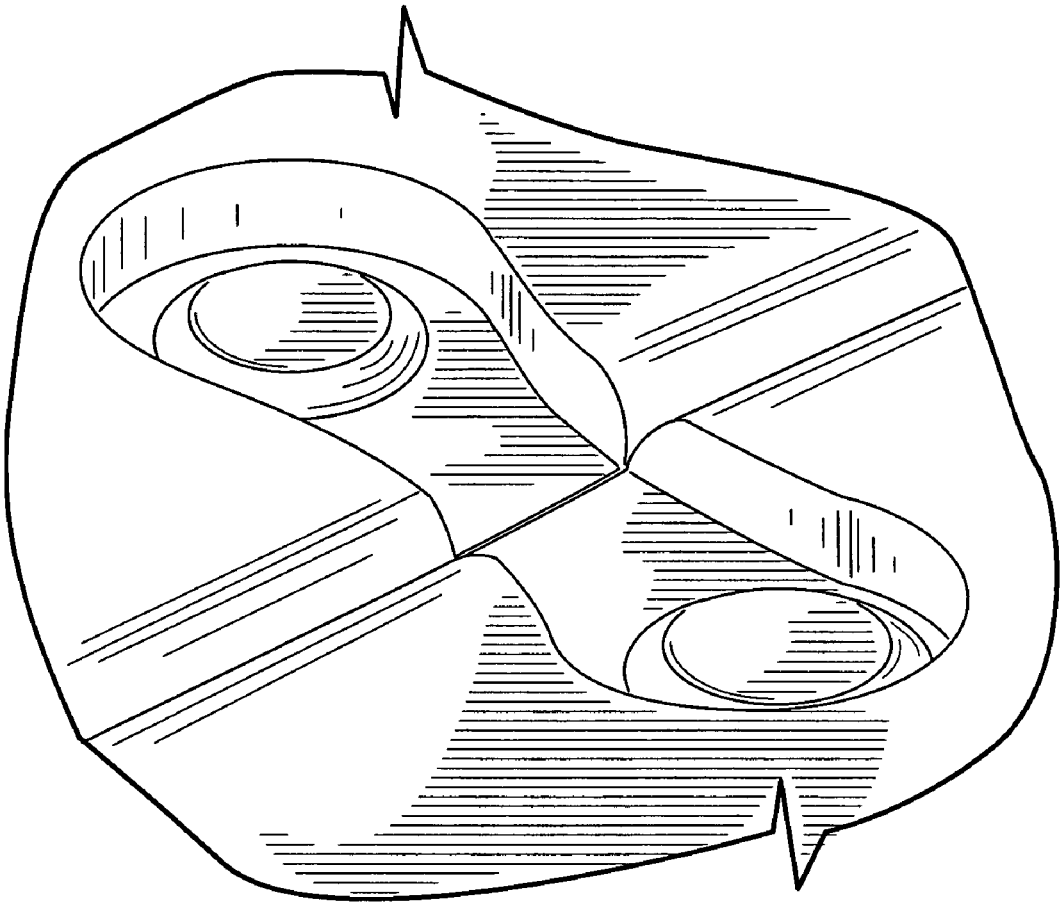
FIG. 7 is a partial perspective view illustrating the connecting link with the upper plate removed.

With reference to FIGS. 1 through 3, the instant invention provides a floating dock element 100, a floating deck element 200 and a connecting link assembly 300. The floating dock element 100 in its preferred embodiment is generally rectangular in overall shape, including a lower generally planar surface 102, an upper receiving surface 104, a front wall 106, a back wall 108, and a pair of side walls 110 for adjoining and maintaining spacing between the upper surface and the lower surface. The upper receiving surface 104 includes two upward standing and generally parallel guide and support rails 112. The guide and support rails 112 are preferably spaced apart and connected by a lowered track-way surface 114. The guide and support rails 112 are constructed and arranged to cooperate with a watercraft keel and/or hull to provide guiding and support when used for drive-on docking. The lowered track-way surface 114 provides clearance for the boat keel when the support rails engage the watercraft hull and also channel water off the upper surface of the dock element 100. The front wail 106 preferably includes a V-shaped entrance guide 116 for aligning and lifting a watercraft keel during drive-on docking. The V-shaped entrance guide includes two diverging planar surfaces 118 and a lifting surface 120. In this manner a precise guiding surface is provided for watercraft having a variety of hull shapes. It should be appreciated that other contoured surface shapes may be employed without departing from the scope of the instant invention. It should also be appreciated that the dock elements may be formed in various sizes to provide the needed buoyancy for various applications.

Still referring to FIGS. 1 through 3, the lower surface 102, upper surface 104 and the front 106, back 108, and side walls 110 of the deck element are formed of polymeric material(s) by conventional methods well known in the art, e.g. blow molding, roto-molding, injection molding and the like. Using these methods, the dock element's lower surface 102, upper surface 104, front 106, back 108 and side walls 110 may be formed continuous or they may include at least one aperture 122 therethrough. In the preferred embodiment the aperture 122 is constructed and arranged to allow the dock element to be filled with expanded polymeric foam 124, as is well known in the art. Alternatively the aperture 122 may be utilized to alter the buoyancy of the dock element 100 by the addition of ballast, e.g. water, sand, metal shot and the like to the internal cavity 126 of the dock element 100.

In a preferred embodiment cooperating with the aperture 122 is one of a variety of caps 128. The caps 128 may be constructed and arranged for threaded or friction welded engagement with the aperture 122 to maintain air tightness within the dock element 100, or the cap 128 may be adapted to include a vent (not shown), allowing air and/or water to flow inwardly and outwardly from within the floatation element internal cavity 126 upon a predetermined pressure.

Referring to FIGS. 1 through 7, the dock element includes a plurality of apertures 130 spaced around the perimeter thereof for connecting adjacently arranged dock and/or deck elements 100, 200. Each aperture includes a continuously and integrally formed aperture wall 132 extending between the upper surface and the lower surface. In one embodiment, the upper receiving surface 104 and the lower surface 102 include a recessed surface 134 extending at least partially around each aperture 130 and extending to the perimeter 136 of the dock element 100. The combination of the recessed surface 134 and the aperture 130 define an upper or lower socket. In one embodiment the recessed surface of the lower socket includes a channel 138 for accepting a strengthening rib which may be integrally formed onto the connecting link 300. In one embodiment, the deck element includes a winch aperture 140 constructed and arranged to accept a hand powered or electric winch (not shown).

Referring to FIGS. 1 through 3, the floating deck element 200 in its preferred embodiment is generally rectangular in overall shape, including an upper generally planar surface 202, a lower generally planar surface 204, a front wall 206, a back wall 208, and a pair of side walls 210 for adjoining and maintaining spacing between the upper surface and the lower surface. The upper surface 102 preferably includes integrally molded texture 212 to provide suitable grip for pedestrian traffic when wet or dry. It should also be appreciated that the deck elements 200 may be formed in various sizes to provide the needed buoyancy for various applications.

Still referring to FIGS. 1 through 3, the deck element's upper surface 202, lower surface 204 and the front 206, back 208, and side walls 210 are formed of polymeric material(s) by conventional methods well known in the art, e.g. blow molding, roto-molding, injection molding and the like. Using these methods the deck element's upper surface 202, lower surface 204, front 206, back 208 and sidewalls 210 may be formed continuous or they may include at least one aperture 122 therethrough. In the preferred embodiment the aperture 122 is constructed and arranged to allow the deck element 200 to be filled with expanded polymeric foam 124, as is well known in the art. Alternatively the aperture 122 may be utilized to alter the buoyancy of the deck element 200 by the addition of ballast, e.g. water, sand, metal shot and the like to the internal cavity 226 of the deck element 200.

In a preferred embodiment cooperating with the aperture 122 is one of a variety of caps 128. The caps 128 may be constructed and arranged for threaded or friction welded engagement with the aperture 122 to maintain air tightness within the deck element 200 or the cap 128 may be adapted to include a vent (not shown), allowing air and/or water to flow inwardly and outwardly from within the floatation element internal cavity 126 upon a predetermined pressure.

Referring to FIGS. 1 through 7, the deck element 200 includes a plurality of apertures 130 spaced around the perimeter thereof for connecting adjacently arranged dock and/or deck elements 100, 200. Each aperture includes a continuously and integrally formed aperture wall 132 extending between the upper surface 102 and the lower surface 104. In one embodiment, the upper receiving surface 104 and the lower surface 102 include a recessed surface 134 extending at least partially around each aperture 130 and extending to the perimeter 136 of the dock element 100. A contoured perimeter wall 142 connects the recessed surface to either the upper or lower surface. The combination of the recessed surface 134 and the aperture 130 define an upper or lower socket 146. The contoured perimeter wall 142 and the recessed surface 134 may be constructed to include an expanded area 144 having a profile similar that of a chain link side plate when placed adjacent to another socket 146. The contoured perimeter permits the perimeter edges 302, 304 of the connecting link upper and lower link plates 306, 308 to interlock with the adjacent sockets to maintain a substantially rigid assembly. Alternatively, the socket and perimeter wall may generally have a U-shape wherein the rigid assembly is maintained by placing the upper and/or lower connecting link plates 306, 308 in tension or compression. In one embodiment the recessed surface of the lower socket 146 includes a channel 138 for accepting a strengthening rib 310 (FIG. 5) which may be integrally formed onto the connecting link 300.

Referring to FIGS. 4 through 7, a connecting link 300 for connecting adjacently arranged dock and/or deck elements 100, 200 into a substantially rigid drive-on dock are illustrated. The connecting link 300 includes a lower plate 308, an upper plate 306, and a pair of link pins 316. The lower plate 308 includes an inner surface 312, an outer surface 314 (FIG. 3), and a perimeter edge 304. The pair of link pins 316 each include an upper portion 318, a lower portion 320 and a longitudinal centerline 322. The lower portion 320 of each link pin is secured or integrally formed onto the inner surface 312 of the lower plate so that the longitudinal centerline 322 is substantially perpendicular to the inner surface of the lower plate. The lower plate may also include an integrally formed rib 310 which extends along the inner surface of the lower plate and is integrally formed to the lower portion of the link pins to add strength and rigidity to the assembly. The upper portion 318 of each link pin includes a bore 324 located generally along the longitudinal centerline 322 for attachment of an upper plate 306. The upper plate 306 includes an inner surface 326, an outer surface 328 and a pair of apertures 330 arranged to align with the link pin apertures 324. The perimeter edges 302, 304 of the upper and lower plates may be constructed to include an expanded area having a profile similar that of a chain link plate for interlocking cooperation with adjacently placed sockets. The contoured perimeter permits the perimeter edges 302, 304 of the connecting link upper and lower link plates 306, 308 to interlock with the adjacent sockets to maintain a substantially rigid assembly. Alternatively, the perimeter edges of the upper and lower plates may have radiused ends and generally straight sides wherein the rigid dock and/or deck assembly is maintained in use by placing the upper and/or lower connecting link plates 306, 308 in tension or compression.

In operation any desired combination of dock and/or deck elements may be placed in an adjacent configuration. A plurality of connecting links 300 may be inserted into the adjacently located sockets 146. The link pins are inserted through the apertures of the adjacently arranged dock element pockets until the inner surface 312 of each lower plate 308 is arranged juxtaposed to the recessed surface 134 of the lower sockets. The inner surface 326 of the upper plate 306 is then arranged juxtaposed to the recessed surface 134 of the upper sockets 146 and a pair of fasteners 150 are inserted through the upper plate apertures 330 and into the link pin apertures 324. In the preferred embodiment the outer surface 328 of the upper plate 306 is substantially co-planar to the upper surface of the adjacent deck and/or dock elements when assembled. In another embodiment the recessed surfaces 134 of the upper and the lower sockets 146 may be omitted wherein the upper 306 and lower 308 link plates set adjacent to the upper or lower surface of respective dock or deck elements.

It should also be appreciated that the dock or the deck elements may be formed in various other polygonal shapes that are adapted to fit together suitably for use as floating walkways, drive-on docks or decks without departure from the scope of the invention. Some of these shapes may include, but should not be limited to rectangles, squares, pentagons, hexagons, octagons and the like.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A floating drive-on dock element comprising:

an upper receiving surface constructed and arranged to guide and support a watercraft thereupon, a generally planar lower surface, a front wall, a back wall, and a pair of side walls for adjoining and maintaining spacing between said upper surface and said lower surface, said receiving surface includes two upward standing and generally parallel guide and support rails, said guide and support rails spaced apart and connected by a lowered track-way surface, wherein said guide and support rails are constructed and arranged to cooperate with a watercraft keel and hull to provide guiding and support when used for drive-on docking, said upper surface, said lower surface, and said front, said back, and said side walls continuously and integrally formed, said continuously formed upper surface, said lower surface, and said front, said back, and said side walls forming an inner cavity, a plurality of apertures spaced around the perimeter of said dock element for connecting adjacently arranged dock elements, each said aperture including an continuously and integrally formed aperture wall extending between said upper surface and said lower surface, said upper receiving surface including a recessed surface extending at least partially around each said aperture and extending to the perimeter of said dock element, said recessed surface and said aperture defining an upper socket, wherein an outer surface of an upper connecting link elate is substantially co-planar with said upper surface when assembled.

2. The floating drive-on dock element according to claim 1 wherein said front wall includes a V-shaped entrance guide for aligning and lifting a watercraft keel during drive-on docking.

3. The floating drive-on dock element according to claim 1 wherein said inner cavity is filled with expanded polymeric foam.

4. The floating drive-on dock element according to claim 1 wherein said aperture is about four inches in diameter.

5. The floating drive-on dock assembly according to claim 1, wherein said lower surface includes a recessed surface extending at least partially around each said aperture and extending to the perimeter of said dock element, said recessed surface and said aperture defining a lower socket.

6. The floating drive-on dock assembly according to claim 5, wherein said recessed surface of said lower socket includes a channel for accepting a connecting link strengthening rib, wherein said outer surface of said lower connecting link plate is substantially co-planar with said lower surface when assembled.

7. The floating drive-on dock element according to claim 1 wherein said dock element includes a vented plug constructed and arranged for allowing air to flow inwardly and outwardly from within said dock element upon a predetermined pressure.

8. A floating deck element comprising:

an upper generally planar surface, a generally planar lower surface, a front wall, a back wall, and a pair of side walls for adjoining and maintaining spacing between said upper surface and said lower surface, said deck element including a plurality of apertures spaced around the perimeter thereof for connecting adjacently arranged deck elements, each said aperture including a continuously and integrally formed aperture wall extending between said upper surface and said lower surface, said upper surface including a recessed surface extending at least partially around each said aperture and extending to the perimeter of said deck element, said recessed surface and said aperture defining an upper socket, said lower surface includes a recessed surface extending at least partially around each said aperture and extending to the perimeter of said deck element, said recessed surface and said aperture defining a lower socket, wherein said lower surface, said front, said back, said side walls and said aperture walls are continuously and integrally formed to define an inner cavity, said inner cavity filled with expanded polymeric foam.

9. The floating deck element according to claim 8, wherein said recessed surface of said lower socket includes a channel therein, wherein said channel is constructed and arranged for accepting a connecting link strengthening rib, wherein said outer surface of a lower connecting link plate is substantially co-planar with said lower surface when assembled.

10. A floating drive-on dock assembly comprising:

a plurality of floatable dock elements, each dock element including an upper receiving surface constructed and arranged to guide and support a watercraft thereupon, a generally planar lower surface, a front wall, a back wall, and a pair of side walls for adjoining and maintaining spacing between said upper surface and said lower surface, said upper surface, said lower surface, and said front, said back, and said side walls continuously and integrally formed, each of said dock elements including a plurality of apertures spaced around the perimeter thereof for connecting adjacently arranged dock elements, each said aperture including a continuously and integrally formed aperture wall extending between said first surface and said second surface;

a connecting link for connecting said adjacently arranged dock elements into a substantially rigid drive-on dock, said connecting link including a lower plate, said lower plate including an inner surface and an outer surface, a pair of link pins, said link pins each including an upper portion, a lower portion and a longitudinal centerline, said lower portion of each said link pin secured to said inner surface of said lower plate, wherein said longitudinal centerline is substantially perpendicular to said inner surface of said lower plate, said upper portion of each said link pin including a centrally located bore therein for attachment of an upper plate, said upper plate including an inner surface, an outer surface and a pair of apertures arranged to align with said link pin apertures;

wherein said inner surface of said lower plate is arranged juxtaposed to said lower surface of said adjacently arranged dock elements, wherein said link pins extend through said apertures of said adjacently arranged dock elements wherein said inner surface of said upper plate is arranged juxtaposed to said upper surface of said adjacently arranged dock elements, wherein a pair of fasteners extend through said upper plate and into said link pin apertures.

11. The floating drive-on dock assembly according to claim 10, wherein said upper receiving surface includes a recessed surface extending at least partially around each said aperture and extending to the perimeter of said dock element, said recessed surface and said aperture defining an upper socket, wherein said outer surface of said upper plate is substantially flush to said upper surface when assembled.

12. The floating drive-on dock assembly according to claim 10, wherein said lower surface includes a recessed surface extending at least partially around each said aperture and extending to the perimeter of said dock element, said recessed surface and said aperture defining a lower socket.

13. The floating drive-on dock assembly according to claim 10, wherein said lower plate and said link pins are integrally formed.

14. The floating drive-on dock assembly according to claim 13, wherein said lower plate and said link pins include an integrally formed strengthening rib, wherein said lower plate includes an inner surface and an outer surface, wherein said strengthening rib extends across said inner surface of said lower plate connecting said link pins.

15. The floating drive-on dock assembly according to claim 12, wherein said recessed surface of said lower socket includes a channel for accepting a strengthening rib, wherein said outer surface of said lower plate is substantially flush to said lower surface when assembled.

16. A floating drive-on dock assembly comprising:

at least one floatable dock element, said at least one dock element including an upper receiving surface constructed and arranged to guide and support a watercraft thereupon, a generally planar lower surface, a front wall, a back wall, and a pair of side walls for adjoining and maintaining spacing between said upper surface and said lower surface, wherein said at least one dock element includes a plurality of apertures spaced around the perimeter thereof for connecting adjacently arranged deck elements, wherein said lower surface, said front, said back, said side walls and said aperture walls are continuously and integrally formed to define an inner cavity, said inner cavity filled with expanded polymeric foam;

at least one floating deck element including an upper generally planar surface, a generally planar lower surface, a front wall, a back wall, and a pair of side walls for adjoining and maintaining spacing between said upper surface and said lower surface, said deck element including a plurality of apertures spaced around the perimeter thereof for connecting adjacently arranged dock elements, each said aperture including a continuously and integrally formed aperture wall extending between said upper surface and said lower surface, wherein said lower surface, said front, said back, said side walls and said aperture walls are continuously and integrally formed to define an inner cavity, said inner cavity filled with expanded polymeric foam;

a connecting link for connecting said adjacently arranged dock and deck elements into a substantially rigid drive-on dock, said connecting link including a lower plate, said lower plate including an inner surface and an outer surface, a pair of link pins, said link pins each including an upper portion, a lower portion and a longitudinal centerline, said lower portion of each said link pin secured to said inner surface of said lower plate, wherein said longitudinal centerline is substantially perpendicular to said inner surface of said lower plate, said upper portion of each said link pin including a centrally located bore therein for attachment of an upper plate, said upper plate including an inner surface, an outer surface and a pair of apertures arranged to align with said link pin apertures;

wherein said inner surface of said lower plate is arranged juxtaposed to said lower surface of said adjacently arranged dock and deck elements, wherein one of said link pins extends through one of said dock element apertures and wherein one of said link pins extends through one of said deck element apertures, wherein said inner surface of said upper plate is arranged juxtaposed to said upper surface of said adjacently arranged dock and deck elements, wherein a pair of fasteners extend through said upper plate and into said link pin apertures.

17. The floating drive-on dock assembly according to claim 16, wherein said upper surface of said deck and said dock element include a recessed surface extending at least partially around each said aperture and extending to the perimeter of said deck or said dock element respectively, said recessed surface and said aperture defining an upper socket, wherein said lower surface of said deck and said dock element includes a recessed surface extending at least partially around each said aperture and extending to the perimeter of said deck or said dock element, said recessed surface and said aperture defining a lower socket.

18. The floating drive-on dock assembly according to claim 17, wherein said upper socket and said lower socket each include a contoured perimeter wall for interlocking cooperation with conjugate shaped upper and lower link plates.

19. The floating drive-on dock assembly according to claim 18, wherein said contoured perimeter wall includes at least one area having expanded width for cooperation with conjugate shaped upper and lower link plates.

* * * * *